US005205549A

United States Patent [19]

Sato et al.

[11] Patent Number: 5,205,549

[45] Date of Patent: Apr. 27, 1993

[54] SHEET HANDLING APPARATUS

[75] Inventors: Shunji Sato; Takeshi Honjo, both of Tokyo, Japan

[73] Assignee: Canon Kabushiki Kaisha, Tokyo, Japan

[21] Appl. No.: 750,236

[22] Filed: Aug. 20, 1991

Related U.S. Application Data

[60] Continuation of Ser. No. 511,291, Apr. 19, 1990, abandoned, which is a division of Ser. No. 90,103, Aug. 27, 1987, Pat. No. 4,940,225.

[30] Foreign Application Priority Data

Aug. 29, 1986 [JP] Japan ..... 61-203394
Aug. 29, 1986 [JP] Japan ..... 61-203395

[51] Int. Cl.[5] ..... B65H 29/60
[52] U.S. Cl. ..... 271/176; 271/294
[58] Field of Search ..... 271/176, 258, 259, 270, 271/294

[56] References Cited

U.S. PATENT DOCUMENTS 3,719,267 3/1973 Reist ..... 271/202 X
4,020,722 5/1977 Byrt ..... 83/312 X
4,147,078 4/1979 Bishop ..... 83/313 X
4,194,421 3/1980 Knoll ..... 83/313 X
4,540,170 9/1985 Masuda et al. .
4,579,327 4/1986 Furuichi .
4,598,901 7/1986 Thomas ..... 271/202
4,629,172 12/1986 Kameyama et al. .
4,641,954 2/1987 Miyata et al. .
4,676,499 6/1987 Kimizuka et al. .

FOREIGN PATENT DOCUMENTS 2168687 12/1984 United Kingdom ..... 271/176

*Primary Examiner*—Richard A. Schacher
*Attorney, Agent, or Firm*—Fitzpatrick, Cella, Harper & Scinto

[57] ABSTRACT

A sheet output apparatus useful in conjunction with a sheet post-processing apparatus, and adapted to perform a predetermined processing of a sheet and then discharge the sheet to the sheet post-processing apparatus, comprising: a transfer mechanism for transferring a sheet to the sheet post-processing apparatus; and a communication mechanism for performing a serial communication of data between the sheet output apparatus and the sheet post-processing apparatus, wherein the communication mechanism transmits a sheet carrier speed data to the sheet post-processing apparatus.

7 Claims, 23 Drawing Sheets

FIG.5

COPIER—SORTER TRANSMISSION DATA

| | MSB 7 | 6 | 5 | 4 | 3 | 2 | 1 | LSB 0 |
|---|---|---|---|---|---|---|---|---|
| 1st FIELD | 0 | 0 | 0 | REQ | BSFT | BCR | PDP | SSTRT |
| | 1st FIELD DESIGNATION | | | | | | | |
| 2nd FIELD | 0 | 0 | 1 | | | | | |
| | 2nd FIELD DESIGNATION | | | SORTER OPERATION MODE SIGNAL | | FUNCTION SIGNAL | | |
| 3rd FIELD | 0 | 1 | 0 | | | | | |
| | 3rd FIELD DESIGNATION | | | DATA DISCRIMINATION BIT | THE COPY SET NUMBER OF SHEETS-SIGNAL OR COPY SHEET SIZE-SIGNAL | | | |
| 4th FIELD | 0 | 1 | 1 | | | | | |
| | 4th FIELD DESIGNATION | | | DATA DISCRIMINATION BIT | THE COPY SET NUMBER OF SHEETS-SIGNAL | | | |
| 5th FIELD | 1 | 0 | 0 | | | | | |
| | 5th FIELD DESIGNATION | | | DATA DISCRIMINATION BIT | THE COPY SET NUMBER OF SHEETS-SIGNAL | | | |
| 6th FIELD | 1 | 0 | 1 | | | | | |
| | 6 th FIELD DESIGNATION | | | DATA DISCRIMINATION BIT | RAM ADDRESS SIGNAL OR WRITE DATA SIGNAL | | | |
| 7th FIELD | 1 | 1 | 0 | | | | | |
| | 7th FIELD DESIGNATION | | | DATA DISCRIMINATION BIT | RAM ADDRESS SIGNAL OR WRITE DATA SIGNAL | | | |
| 8th FIELD | 1 | 1 | 1 | 1 | 1 | 1 | 1 | 1 |
| | 8th FIELD DESIGNATION | | | ERROR CODE SIGNAL | | | | |

FIG. 6

| |
|---|
| FIG. 6 a |
| FIG. 6 b |

FIG. 6a

| | SIGNAL NAME | | MEANING · FUNCTION |
|---|---|---|---|
| SORTER ⇨ COPIER | SSTRT | SORTER · START SIGNAL | SORTER · START |
| | PDP | COPIER DELIVERY SIGNAL | INFORMING OF THE FACT THAT COPY SHEET PRESENTS ON DELIVERY SENSOR OF COPIER |
| | BCR | BIN RETURN SIGNAL | RETURNING BIN OF SORTER TO HOME POSITION |
| | BSFT | BIN SHIFT SIGNAL | SHIFTING BIN OF SORTER |
| | REQ | REQUEST SIGNAL | OUTPUTING THIS SIGNAL AT THE TIME OF JAM, AND RECEIVING THE NUMBER OF SORTER STORAGE SHEETS |
| | | SORTER OPERATION MODE SIGNAL | SENDING TO SORTER A SORTER OPERATION MODE SELECTED IN COPIER |
| | | FUNCTION SIGNAL | SENDING A MAIN BODY OPERATION MODE TO SORTER (SORTER MODE DETERMINATION SIGNAL ETC.) |
| | | THE COPY SET NUMBER OF SHEETS-SIGNAL | SENDING TO SOTER THE NUMBER OF COPY SHEETS SET IN COPIER |

FIG.6b

| | |
|---|---|
| COPY SHEET SIZE-SIGNAL | SENDING TO SORTER COPY SHEET SIZE SELECTED IN COPIER |
| RAM ADDRESS SIGNAL | SENDING TO SORTER RAM ADDRESS (LOWER DIGITS: 8 BITS) AT SORTER CONTROL MICRO COMPUTER SIDE SELECTED IN COPIER |
| WRITE DATA SIGNAL | SENDING TO SORTER WRITE DATA INTO RAM AT SORTER CONTROL MICRO COMPUTER SIDE SET IN COPIER |
| ERROR CODE SIGNAL | SENDING IT TO SORTER WHEN ERROR OCCURRED IN SORTER TRANSMISSION DATA |

FIG. 7

SORTER—COPIER TRANSMISSION DATA

| | MSB 7 | 6 | 5 | 4 | 3 | 2 | 1 | LSB 0 |
|---|---|---|---|---|---|---|---|---|
| 1st FIELD | 0 | 0 | 0 | | SPEED | ALARM | SJAM | SSTBY |
| | 1st FIELD DESIGNATION | | | | | | | |
| 2nd FIELD | 0 | 0 | 1 | | | | | |
| | 2nd FIELD DESIGNATION | | | SORTER OPERATION MODE SIGNAL | | | | |
| 3rd FIELD | 0 | 1 | 0 | | | | | |
| | 3rd FIELD DESIGNATION | | | DATA DIS-CRIMI-NATION BIT | THE TOTAL NUMBER OF SORTER BINS-SIGNAL OR THE NUMBER OF SORTER STORAGE SHEETS | | | |
| 4th FIELD | 0 | 1 | 1 | | | | | |
| | 4th FIELD DESIGNATION | | | DATA DIS-CRIMI-NATION BIT | THE TOTAL NUMBER OF SORTER BINS-SIGNAL OR THE NUMBER OF SORTER STORAGE SHEETS | | | |
| 5th FIELD | 1 | 0 | 0 | | | | | |
| | 5th FIELD DESIGNATION | | | DATA DIS-CRIMI-NATION BIT | THE TOTAL NUMBER OF SORTER BINS-SIGNAL OR THE NUMBER OF SORTER STORAGE SHEETS | | | |
| 6th FIELD | 1 | 0 | 1 | | | | | |
| | 6th FIELD DESIGNATION | | | DATA DIS-CRIMI-NATION BIT | READ DATA SIGNAL | | | |
| 7th FIELD | 1 | 1 | 0 | | | | | |
| | 7th FIELD | | | DATA DIS-CRIMI-NATION BIT | READ DATA SIGNAL | | | |
| 8th FIELD | 1 | 1 | 1 | 1 | 1 | 1 | 1 | 1 |
| | 8th FIELD | | | ERROR CODE SIGNAL | | | | |

FIG.8

| | SIGNAL NAME | | MEANING · FUNCTION |
|---|---|---|---|
| SORTER ⇨ COPIER | SSTBY | SORTER · STANDBY SIGNAL | INFORMING COPIER OF THE FACT THAT SORTER IS IN OPERABLE CONDITION |
| | SJAM | SORTER · JAM SIGNAL | INFORMING COPIER OF THE FACT THAT JAM DCCURRED IN SORTER |
| | ALARM | ALARM SIGNAL | INFORMING COPIER OF THE FACT THAT SORTER IS IN INOPERABLE CONDITION BECAUSE SORTER IS NOT PROPERLY CONNECTED WITH COPIER |
| | | SORTER OPERATION MODE SIGNAL | SENDING SORTER OPERATION MODE SELECTED IN SORTER TO COPIER |
| | | THE TOTAL NUMBER OF SORTE BINS-SIGNAL | INFORMING COPIER OF THE TOTAL NUMBER OF SORTER BINS-SIGNAL |
| | | THE NUMBER OF SORTER STORAGE SHEETS-SIGNAL | SENDING TO COPIER THE NUMBER OF COPY SHEETS WHICH ARE OBTAINED FROM THE SAME ORIGINAL AND BE STORED IN BIN OF SORTER |
| | | READ DATA SIGNAL | SENDING TO COPIER READ DATA FROM RAM AT SORTER CONTROL MICRO COMPUTER SIDE SET IN COPIER |
| | | ERROR CODE SIGNAL | SENDING IT TO COPIER WHEN ERROR OCCURRED IN COPIER TRANSMISSION DATA |
| | SPEED | SORTER · SPEED SIGNAL | INFORMING COPIER OF THE FACT THAT SORTER CARRIER SPEED IS ABNORMAL |

SHEET HANDLING APPARATUS

This application is a continuation of application Ser. No. 511,291 filed Apr. 19, 1990, which is a divisional application of Ser. No. 090,103, filed Aug. 27, 1987, now U.S. Pat. No. 4,940,225.

BACKGROUND OF THE INVENTION

1. Field of the Invention

The present invention relates to a sheet output apparatus adapted to perform predetermined processes for a sheet and capable of being used in conjunction with a sheet post-processing apparatus.

2. Related Background Art

Hitherto, there is a case where a sheet post-processing apparatus such as a sorter or the like is connected with a sheet output apparatus such as a copier or the like and used. In general, a sheet carrier speed of the sorter is set to be faster than that of the copier main unit. Although the sheet carrier speed are preset, there is cases in which the carrier speed changes during the operation of the sorter. If the sorter is continuously used in such a sheet state, a jam or the like will frequently occur in the sorter.

In such a sorter, in the case of detecting the abnormality of conveyance of the sheet such as a jam of the like, a peculiar value of a timer is predetermined in accordance with the sorter. Therefore, the additional operation of the timer for detection of the jam is necessary in dependence on the sheet and the timing for detection of the jam is delayed or the detecting accuracy of the jam deteriorates.

SUMMARY OF THE INVENTION

The present invention is made in consideration of the foregoing drawbacks and it is an object of the invention to provide an improved sheet output apparatus.

Another object of the invention is to provide a sheet output apparatus which can prevent the occurrence of abnormality of the conveyance of a sheet.

Still another object of the invention is to provide a sheet output apparatus which can detect the abnormality of the carrier speed of a sheet.

Still another object of the invention is to provide a sheet handling apparatus which can accurately detect the abnormality of conveyance of a sheet.

Still another object of the invention is to provide a sheet handling apparatus which can detect the abnormality of conveyance of a sheet without requiring a longer time than necessary in accordance with the size of sheet.

The above and other objects and features of the present invention will become apparent from the following detailed description and the appended claims with reference tot he accompanying drawings.

BRIEF DESCRIPTION OF THE DRAWINGS

FIG. 4-1 is a time chart for serial communication between a sorter controller and a copier controller;

FIG. 4-2 is a diagram showing a serial communication data format;

FIG. 5 is a diagram showing transmission data from a copier to a sorter;

FIG. 6 consisting of FIGS. 6*a* and 6*b*, is a diagram showing the meanings/functions of signals which are sent from the copier to the sorter;

FIG. 7 is a diagram showing transmission data which are sent from the sorter to the copier;

FIG. 8 is a diagram showing the meanings/functions of signals which are sent from the sorter to the copier;

FIGS. 9-1 to 9-8 are control flowcharts for serial communication;

DETAILED DESCRIPTION OF PREFERRED EMBODIMENTS

An embodiment of the present invention will be described hereinbelow with reference to the drawings.

Figure 1:
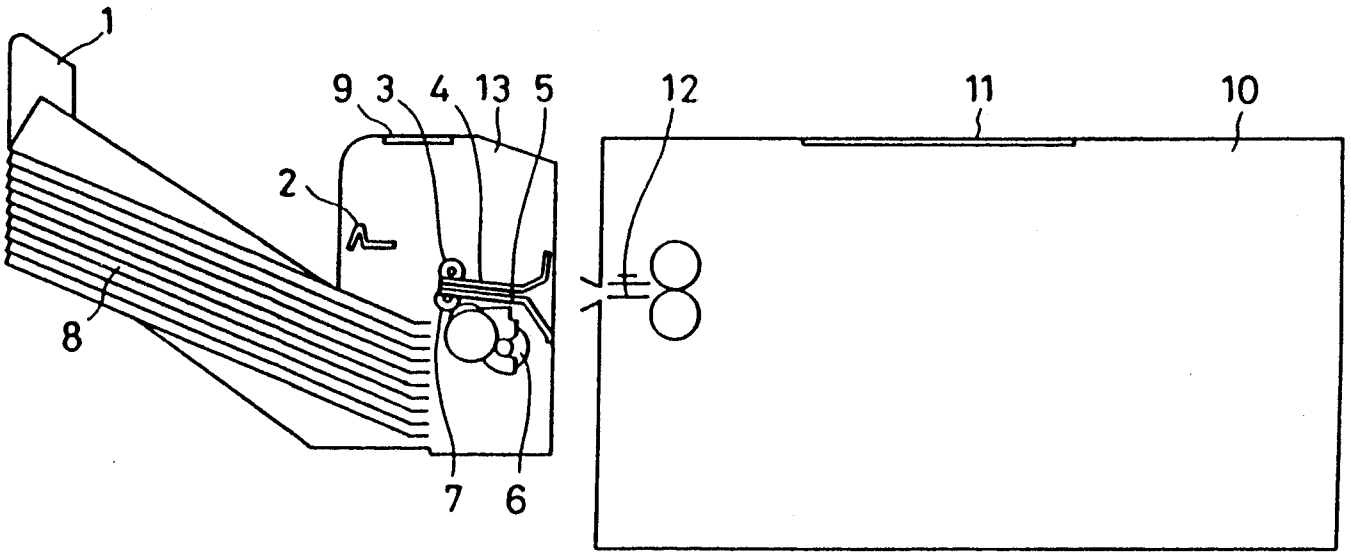
FIG. 1 is a diagram showing a schematic constitution of a sheet output apparatus in conjunction with a sheet post-processing apparatus to which the present invention is applied.

As shown in FIG. 1, a bin moving type sheet sorter 13 (hereinafter, referred to as a sorter) is connected with a copier 10.

Figure 2:
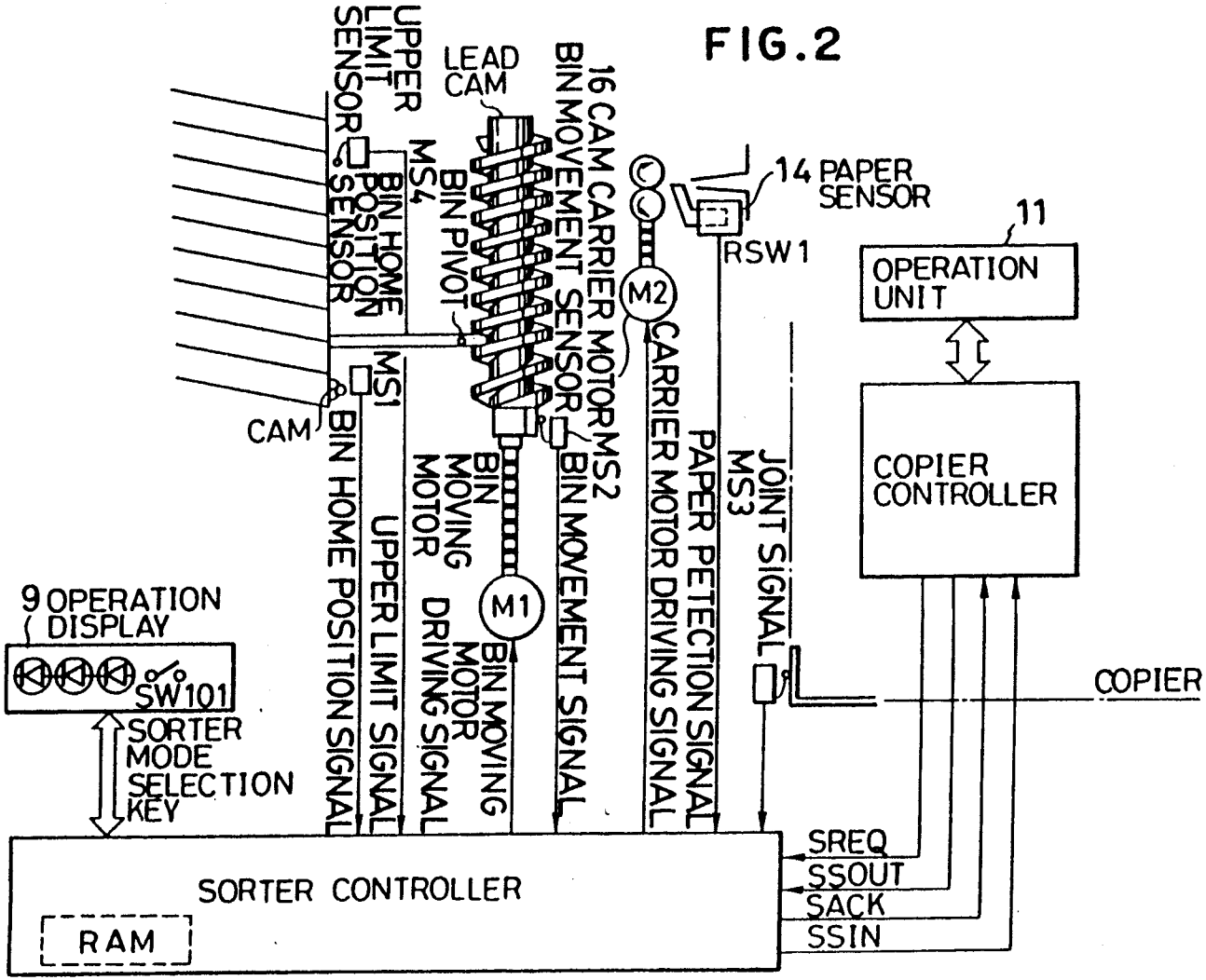
FIG. 2 is a block diagram showing a control unit of the sheet output apparatus in conjunction with a sheet post-processing apparatus as shown in FIG. 1.

FIG. 2 shows a serial communication block diagram between the copier and the sorter.

In the copier, a copier controller performs the interaction with the operator, namely, reads commands to instruct a desired copy set number of sheets, copy start/stop, cassette size, or the like from an operation unit 11. The copier controller controls the operation sequence of the copier and also controls the sorter via serial communication.

A sorter controller transmits and receives data to and from the copier via serial communication, outputs various kinds of information to a display unit, and controls the operation sequence of the sorter.

SREQ denotes a serial communication request signal between the copier and the sorter; SACK is a serial communication start signal; and SSOUT and SSIN are serial communication lines between the copier and the sorter.

As a microcomputer for control of the sorter, it is possible to use a one-chip microcumputer (e.g., μCOM87AD made by NEC) having the asynchronous serial interface function and the like and also including therein an RAM which can be backed up.

Figures 1, 4:
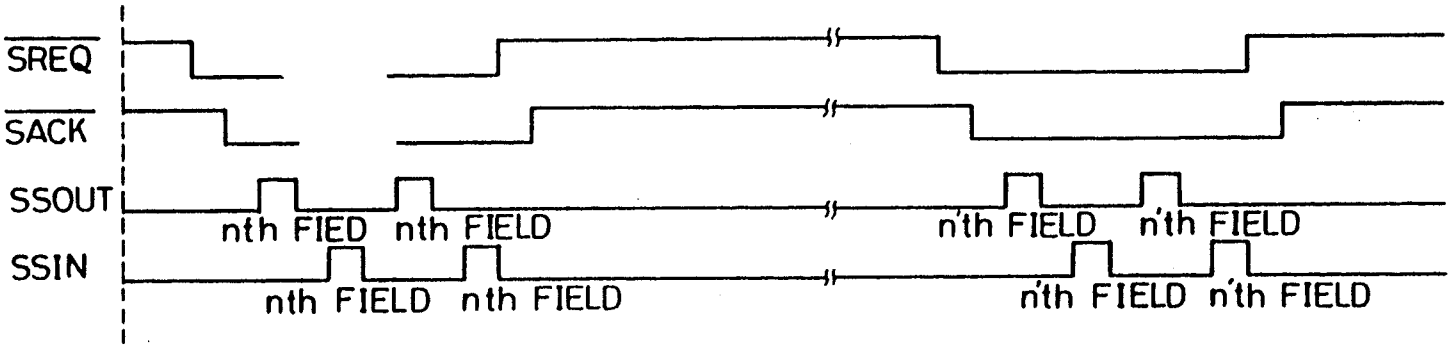
Figures 2, 4:
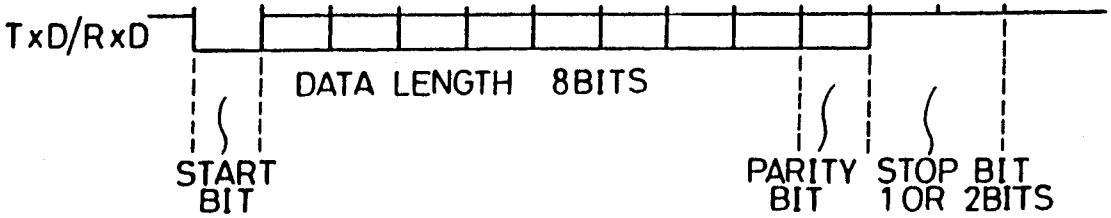

FIG. 4-1 shows a time chart for asynchronous serial communication. FIG. 4-2 shows a data format for asynchronous serial communication. In a single serial coummunication, the same filed data is transmitted and received twice and the data is compared. When the data is equal, this data is identified. In the next serial communication, another field data is similarly transmitted and received twice. If the received data is not identified because of the occurrence of some errors during the communication, the same field data is also transmitted and received by a similar method in the next communication.

Figures 1A, 9:
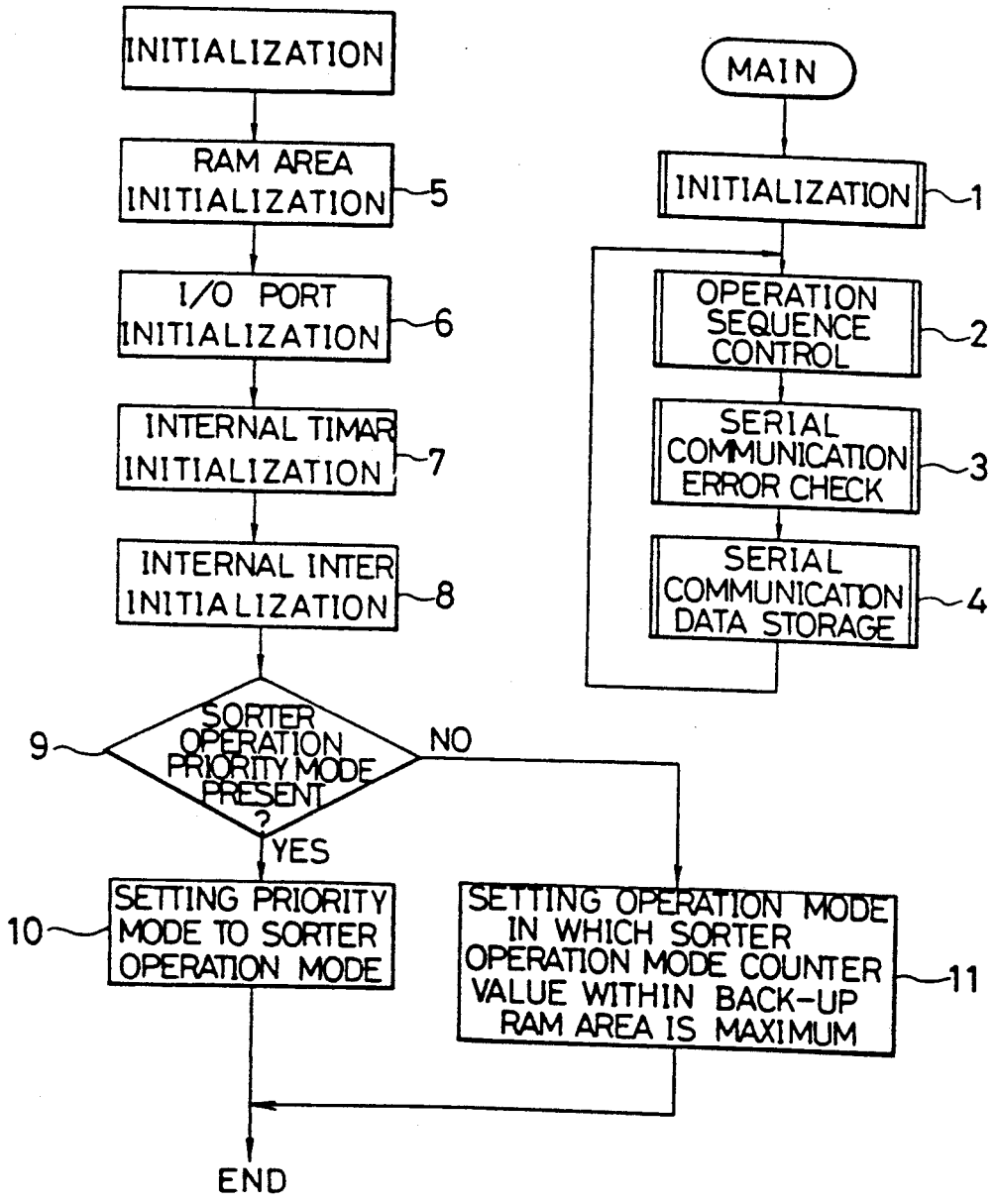
Figures 1B, 9:
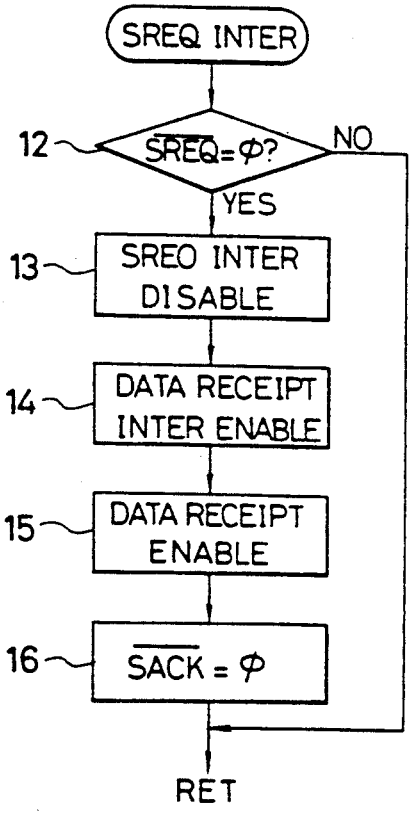
Figures 2B, 9:
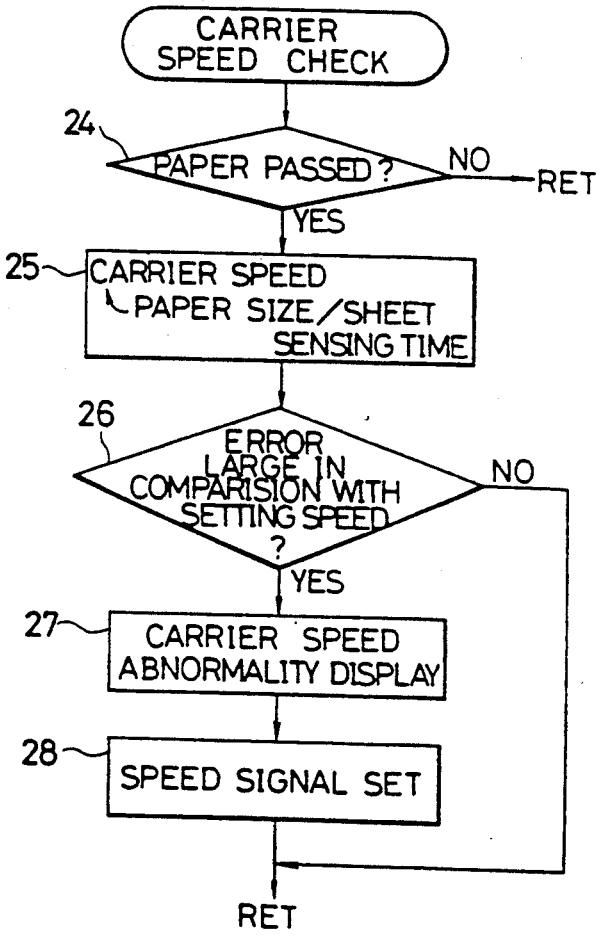
Figures 2A, 9:
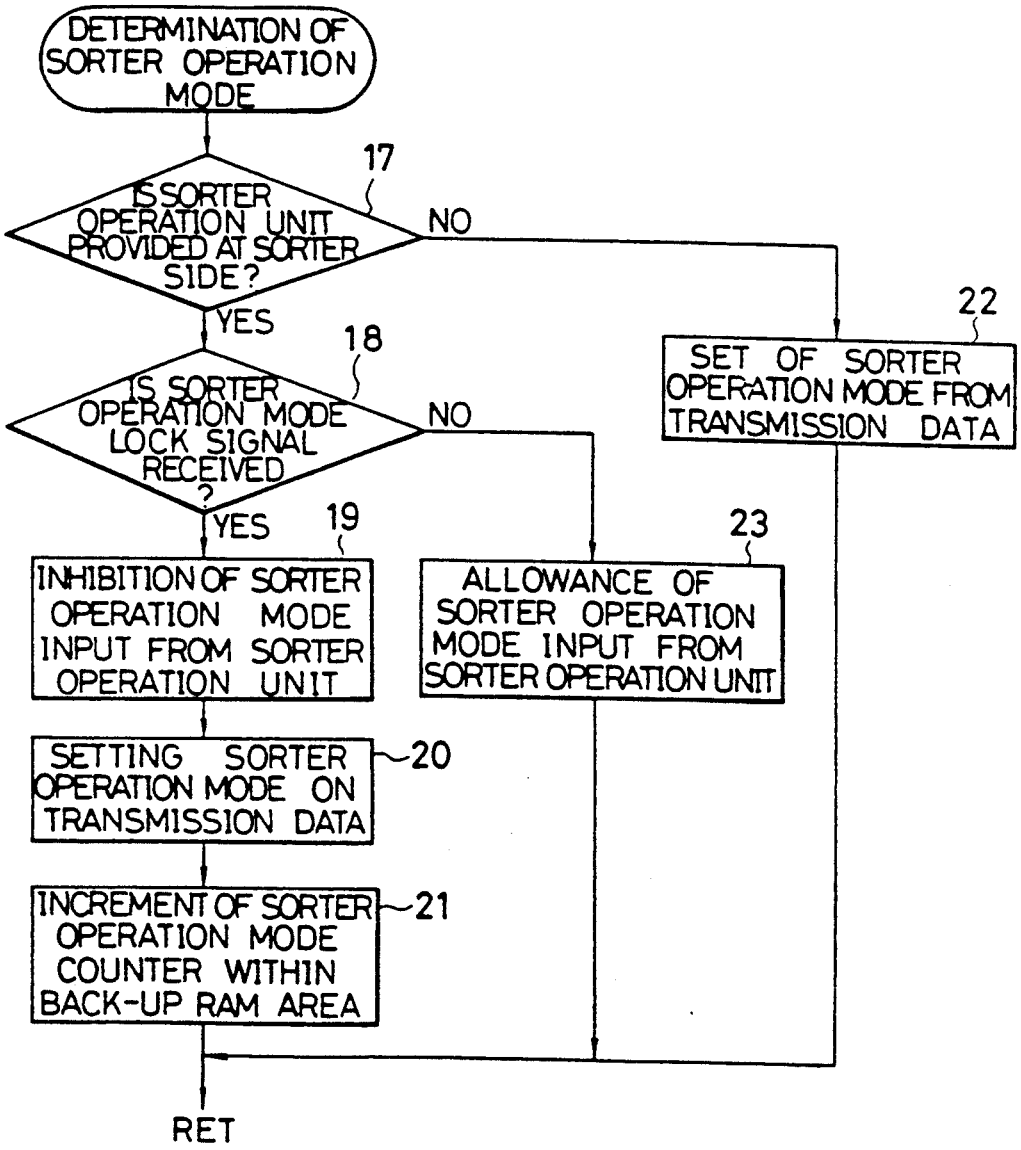
Figures 3, 9:
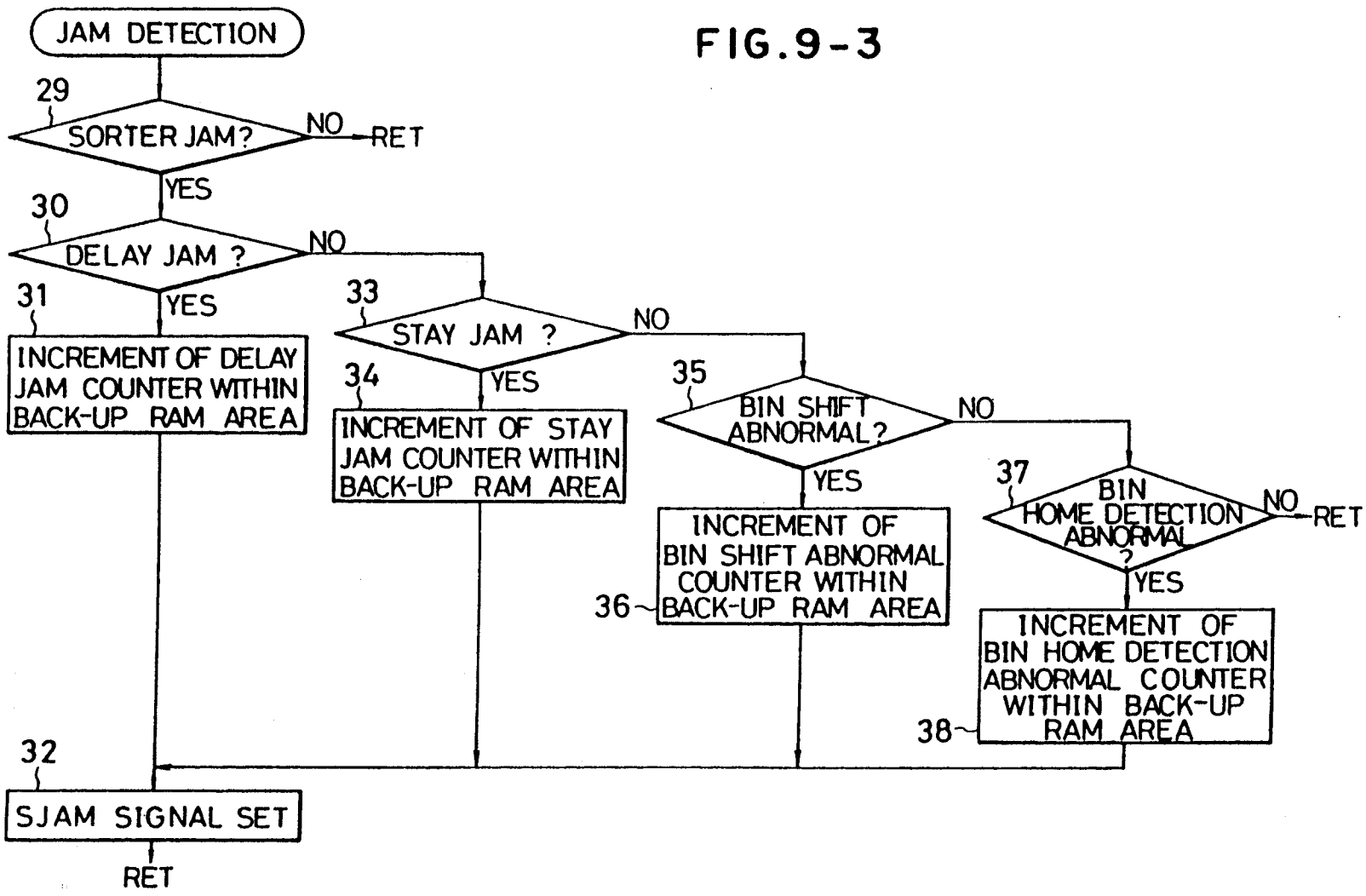
Figures 4A, 9:
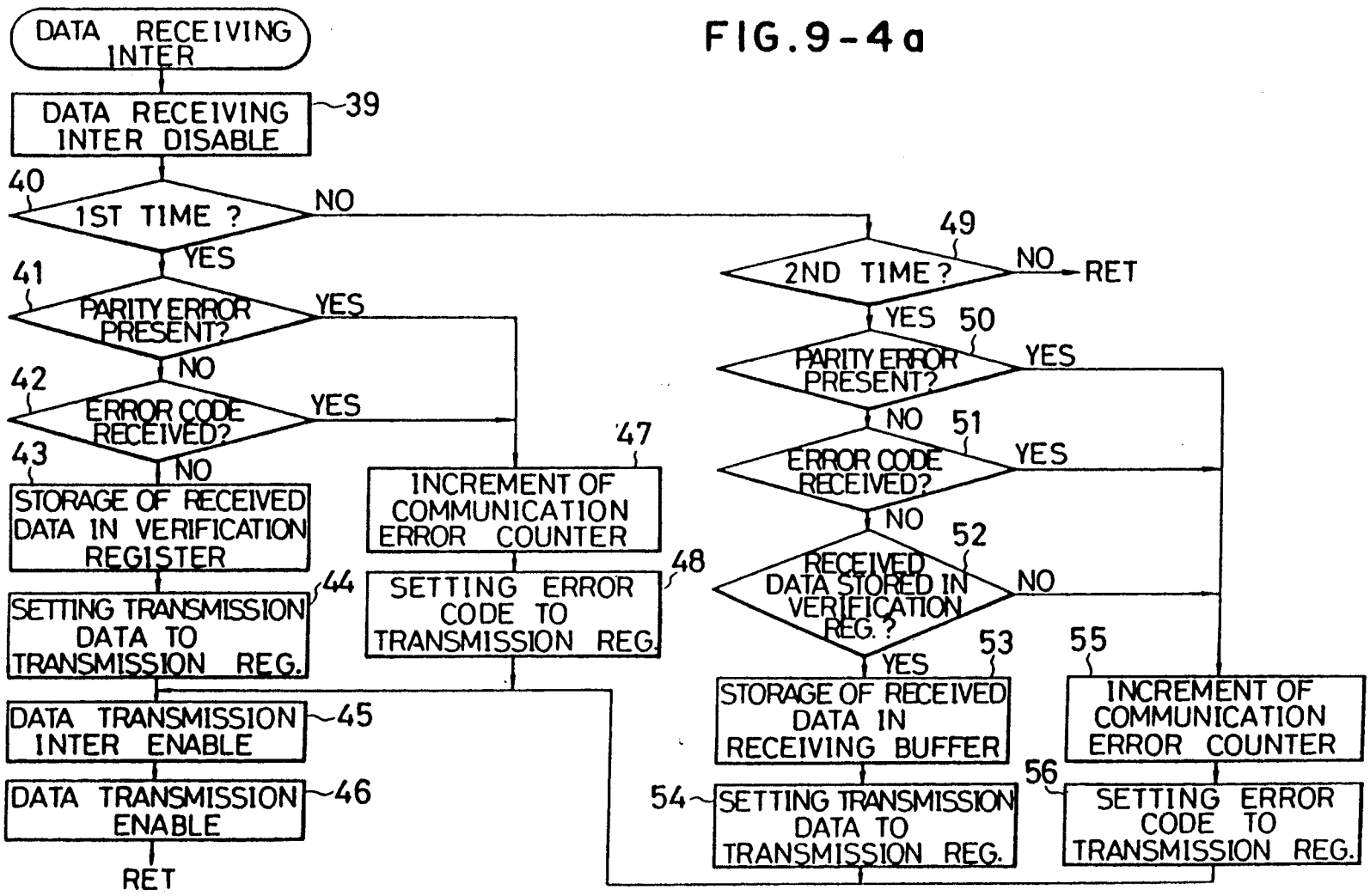
Figures 4B, 9:
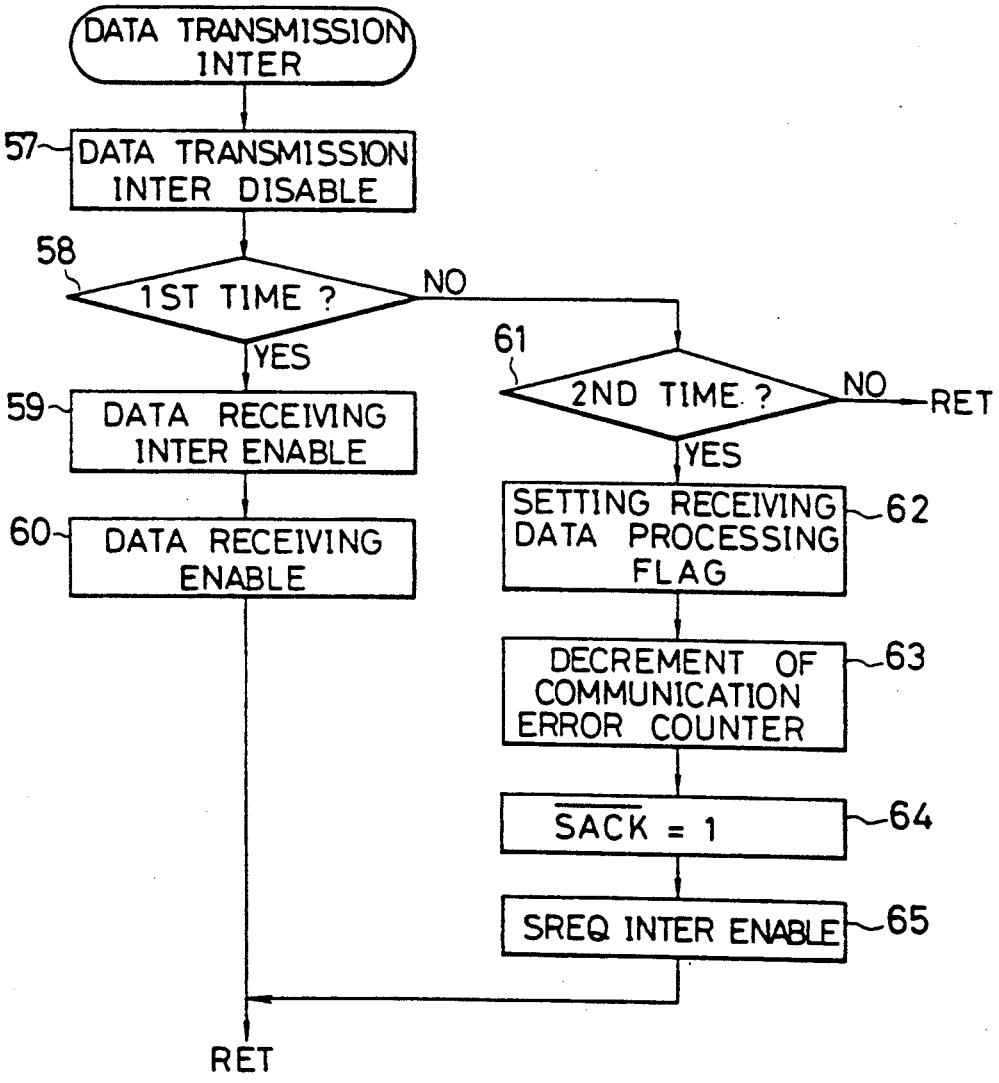
Figures 5, 9:
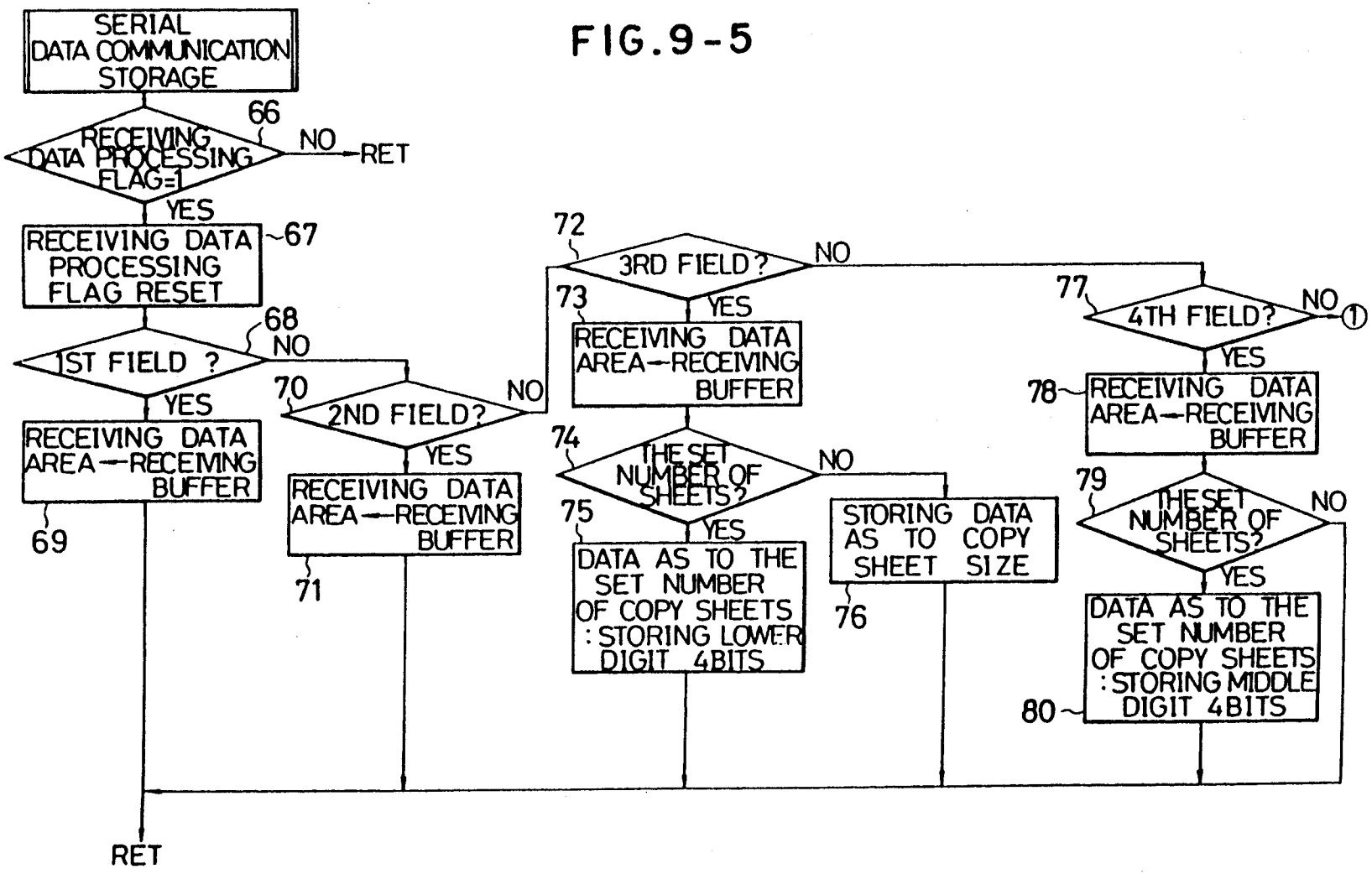
Figures 6, 9:
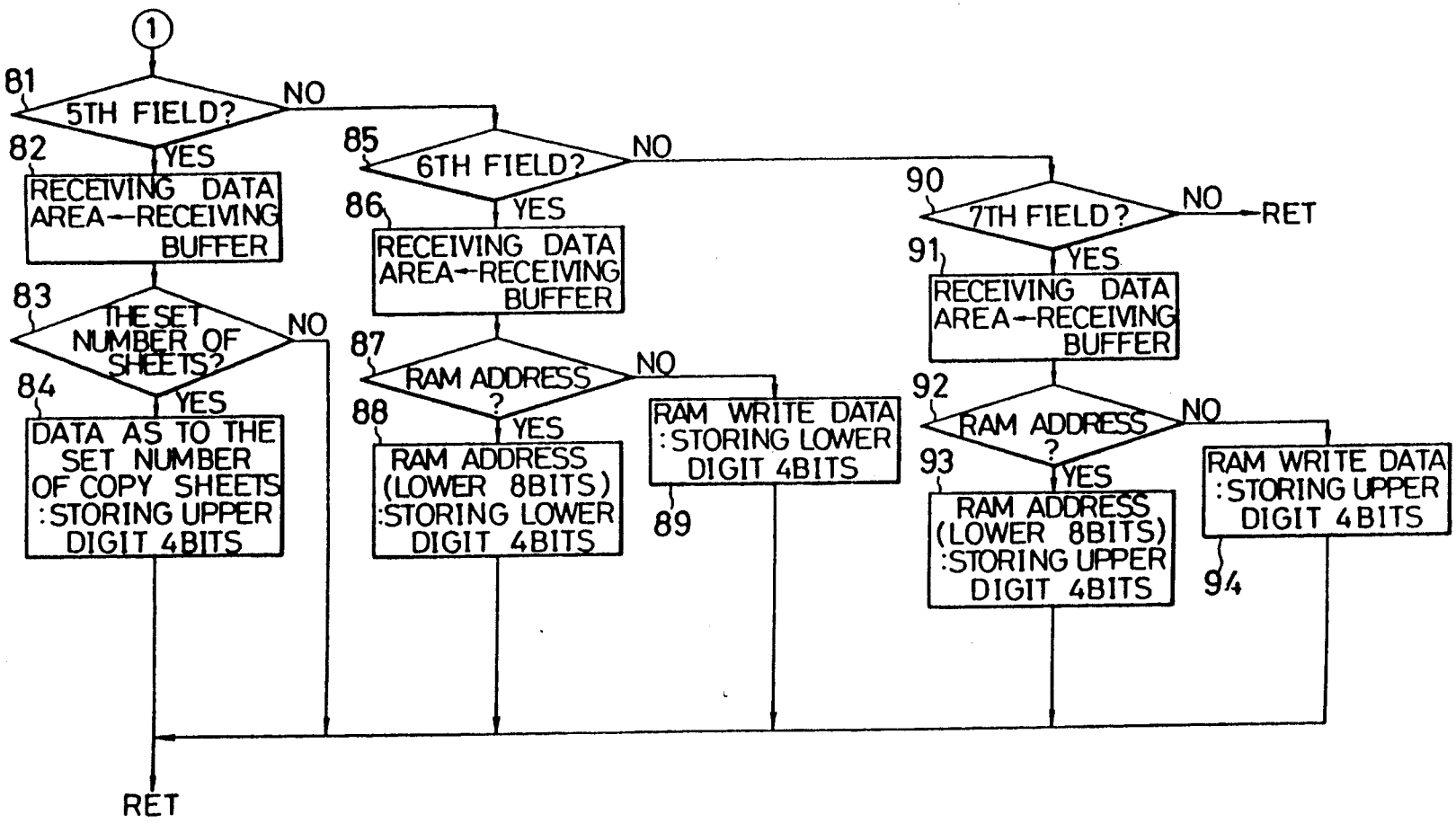
Figures 7, 9:
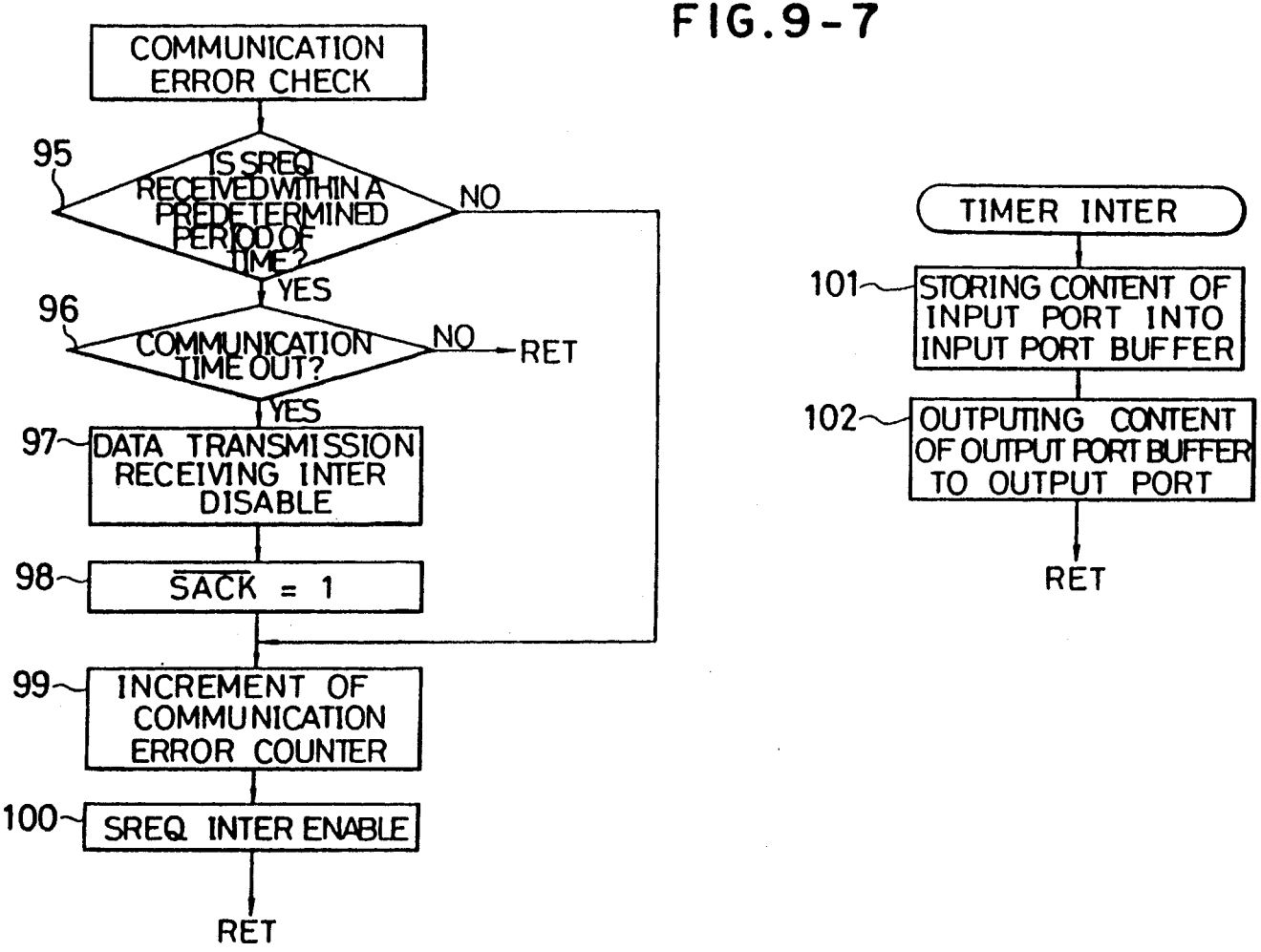

FIGS. 5 to 8 show a structure of each field data, and names, meanings, and function of control signals. FIGS. 9-1 to 9-7 show serial communication control flowcharts. The operation will now be described hereinbelow with reference to these flowcharts. After the power source is turned on, the sorter control microcomputer executes the initializing routine in step 1. This routine is shown in detail in steps 5 to 11. Namely, the RAM is initialized, the input/output ports are initialized, and the internal interruption is set. Thereafter, a check is made to see if the sorter operation priority mode has been set or not. If it has been set, the priority mode is set into the sorter operation mode. If NO, the-operation mode in which the count value of the sorter operation mode counter in the back-up RAM area is the maximum is set into the sorter operation mode. Then, the operation sequence control and the serial coummunication error check (which will be shown in detail in steps 95 to 100 in FIG. 9-7) and the serial communication data storage (which will be shown in detail in FIGS. 9-5 and 9-6) are sequentially executed, and the apparatus waits for the input of the SREQ signal from the copier control microcomputer. (steps 2 to 4)

Figure 3:
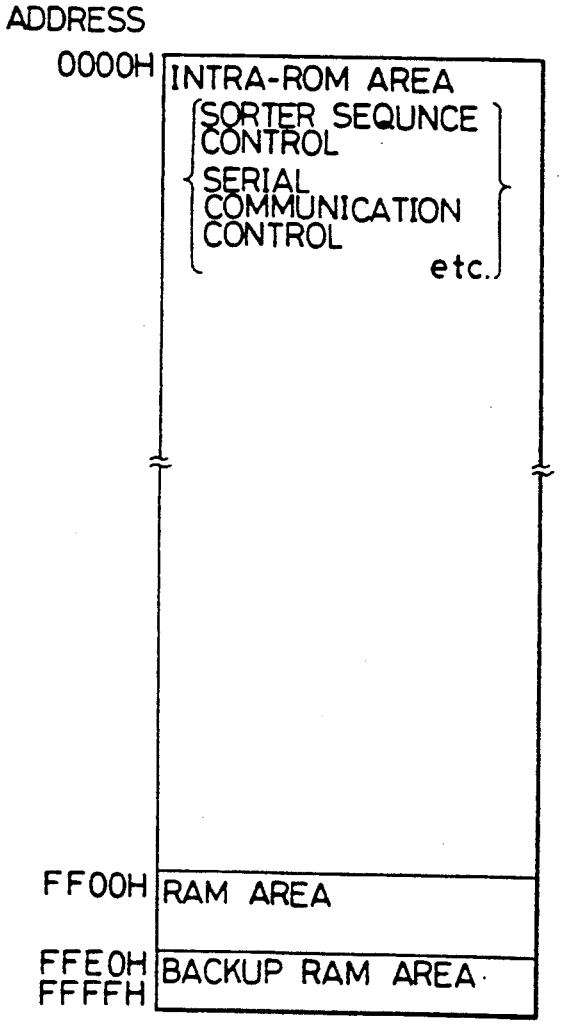
FIG. 3 is a diagram showing a memory map of a sorter controller/one-chip microcomputer.
Figures 8, 9:
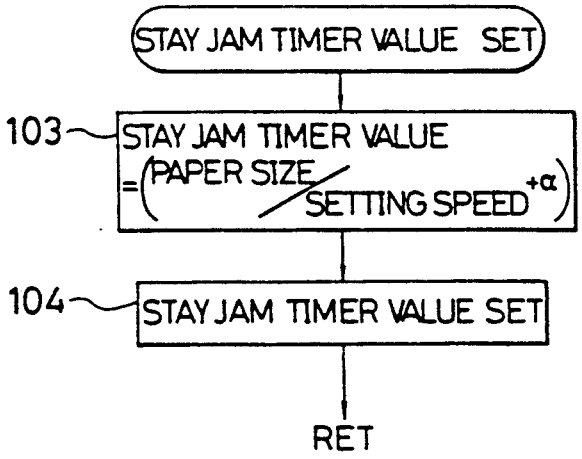
Figure 10:
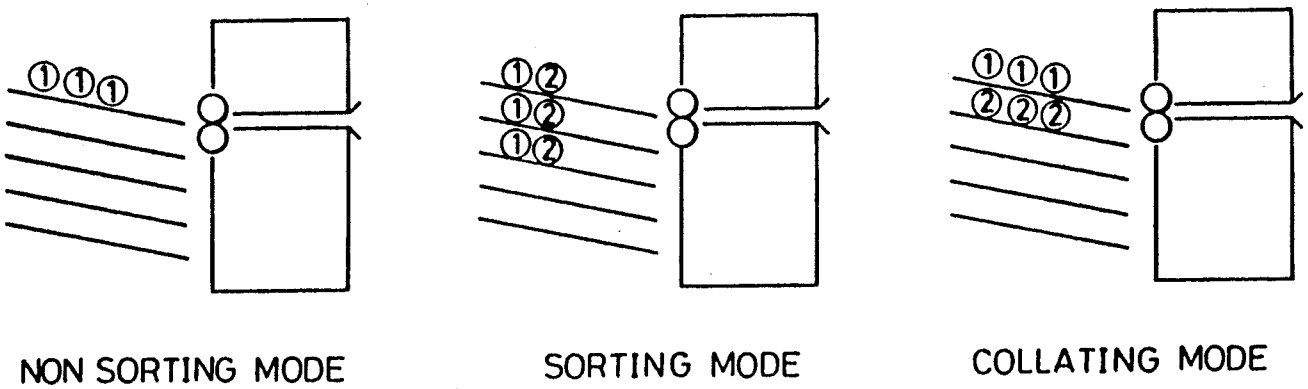
FIG. 10 is a diagram showing an enclosing state of sheets in each operation mode of the sorter.

In steps 2 to 4, the sorter mode deciding routine and carrier speed checking routine shown in FIG. 9-2, the JAM detecting routine shown in FIG. 9-3, and the stay jam timer value setting routine shown in FIG. 9-8 are executed.

The timer interrupting routine is executed at every predetermined period of time by the interruption of an internal timer of the microcomputer. In the timer interrupting routine, the content (input states of various kinds of sensors or the like) of the input port of the microcomputer is stored into an input port buffer provided in the RAM. The content (various kinds of load drive information or the like) of the output port buffer provided in the RAM is output to an output port of the microcomputer. (steps 101 and 102).

The copier control microcomputer sends the SREQ signal to the sorter control microcomputer simultaneously with the start of the serial communication. When the sorter control microcomputer receives the SREQ signal, it generates an internal interruption signal and executes the SREQ interrupting routine. In the SREQ interrupting routine, the data receiving interruption and data reception are enabled and the SACK signal is transmitted to the copier control microcomputer. (steps 12 to 16)

In response to the SACK signal, the copier control microcomputer transmits the first transmission data to the sorter control microcomputer. In response to the first transmission data, the sorter control microcomputer generates the internal interruption signal and executes the data receiving interrupting routine shown in FIG. 9-4.

In the data receiving interrupting routine, a check is made to see if a parity error has occurred or not and a check is also made to see if the received data is an error code or not. Thereafter, if the received data is the correct data, it is temporarily stored into a verification register provided in the RAM in the sorter controller. The same field data as the received data is set into a transmission register. If the received data is the incorrect data, the count value of a communication error counter (provided in the RAM) with the main unit is increased. The error code is set into the transmission register. The data transmission interruption and data transmission are enabled. Then, the interrupting routine is finished. (steps 39 to 48)

After completion of the first data transmission, the sorter control microcomputer executes the data transmission interrupting routine shown in FIG. 9-4. In the data transmission interrupting routine, after completion of the first data transmission, the data receiving interruption and data reception are enabled. Then, the transmission interrupting routine is finished. (steps 57 to 60)

When the copier control microcomputer receives the first transmission data from the sorter control microcomputer, it checks the presence or absence of an error. If no error is detected, the same data as the first transmission data is transmitted as the second transmission data to the sorter control microcomputer. When the sorter control microcomputer receives the second transmission data, it generates the internal interruption signal and executes the data receiving interrupting routine.

In the data receiving interrupting routine, a check is made to see if a parity error has occurred or not and a check is also made to see if the received data is the error code or not. Thereafter, if the received data is the correct data, the received data is stored into a receiving buffer provided in the RAM in the sorter controller and the same data as the frist transmission data is set as the second transmission data into a transmitting register. If the received data is the incorrect data, the error code is set into the transmitting register. The data transmission interruption and data transmission are enabled. Then, the receiving interruption routine is finished. (steps 39 to 40 and 49 to 56)

After completion of the second data transmission, the sorter control microcomputer executes the data transmission interrupting routine. In the data transmission interrupting routine, after completion of the second data transmission, a receiving data processing flag is set. The communication error counter value is decreased. The SACK signal is turned off. The SREQ interruption is again enabled to perform the serial communication with the copier control microcomputer. Then, the data transmission interruption routine is finished. (steps 57 and 58 and 61 to 65)

Further, a check is made to see if the serial communication has been finished within a set period of time or not and a check is also made to see if the communication error counter is in the counting end state (communication abnormal state) or not by the communication error checking routine in the main routine. (step 3) This routine is shown in detail in FIG. 9-7. In the communication error checking routine, first, a check is made to see if the SREQ signal has been received within a predetermined period of time or not and a check is also made to see if the serial communication has been finished within a set period of time or not. If NO, the count value of the communication error counter is increased and the SREQ interruption is enabled in order to perform the next serial communication with the copier control microcomputer. (steps 95 to 100)

Further, the data received by the serial communication is processed by the serial communication data storing routine in the main routine. (step 4) This routine is shown in detail in FIG. 9-5.

If the receiving data processing flag has been set, it is reset and a check is made to see if the field of the receiving data has been designated or not. If the first and second fields have been designated, the receiving data is stored into the receiving data area provided in the RAM.

If the third field has been designated, the receiving data is stored into the receiving data area provided in the RAM. If the receiving data is the set copy number of sheets data, lower digit four bits of the set copy number of sheets data consisting of twelve bits are updated.

If the receiving data is the size data, the size data is updated.

In the case of the fourth field, the receiving data is stored into the receiving data area provided in the RAM. If the receiving data is the set copy number of sheets data, middle digit four bits of the set copy number of sheets data consisting of twelve bits are updated.

In the case of the fifth field, the receiving data is stored into the receiving data area provided in the RAM. If the receiving data is the set copy number of sheets data, upper digit four bits of the set copy number of sheets data consisting of twelve bits are updated.

In the case of the sixth field, the receiving data is stored into the receiving data area provided in the RAM. In the case of the RAM address data, lower digit four bits of the RAM address data consisting of eight bits are updated. If the receiving data is the write data, lower digit four bits of the write data consisting of eight bits are updated.

In the case of the seventh field, the receiving data is stored into the receiving data area provided in the RAM. In the case of the RAM address data, upper digit four bits of the RAM address data consisting of eight bits are updated. If the receiving data is the write data, upper digit four bits of the write data consisting of eight bits are updated.

In the case of the sixth and seventh fields, if the receiving data is the RAM address data, the operation mode is set into the RAM reading mode. The RAM data which is accessed by the 16-bit address (upper digit eight bits are the fixed values) whose lower digit eight bits are the received RAM address data is set as the transmission data.

If the receiving data is the write data, the operation mode is set into the RAM writing mode. The write data is written into the RAM which is accessed by the RAM address data which has previously been received. (steps 66 to 94). The sorter carrier speed setting data, which will be explained hereinlater, is transmitted from the copier controller to the sorter controller by use of the sixth and seventh fields.

Control signals are transmitted and received by the foregoing serial communication and the sorter is made operative. The operation of the sorter will now be described hereinbelow. (Refer to FIGS. 10 to 13).

OPERATION

The sorter operation mode includes the non-sorting mode, sorting mode, and collating mode.

1. Non-sorting mode (single original and three copy sheets)

Figure 11:
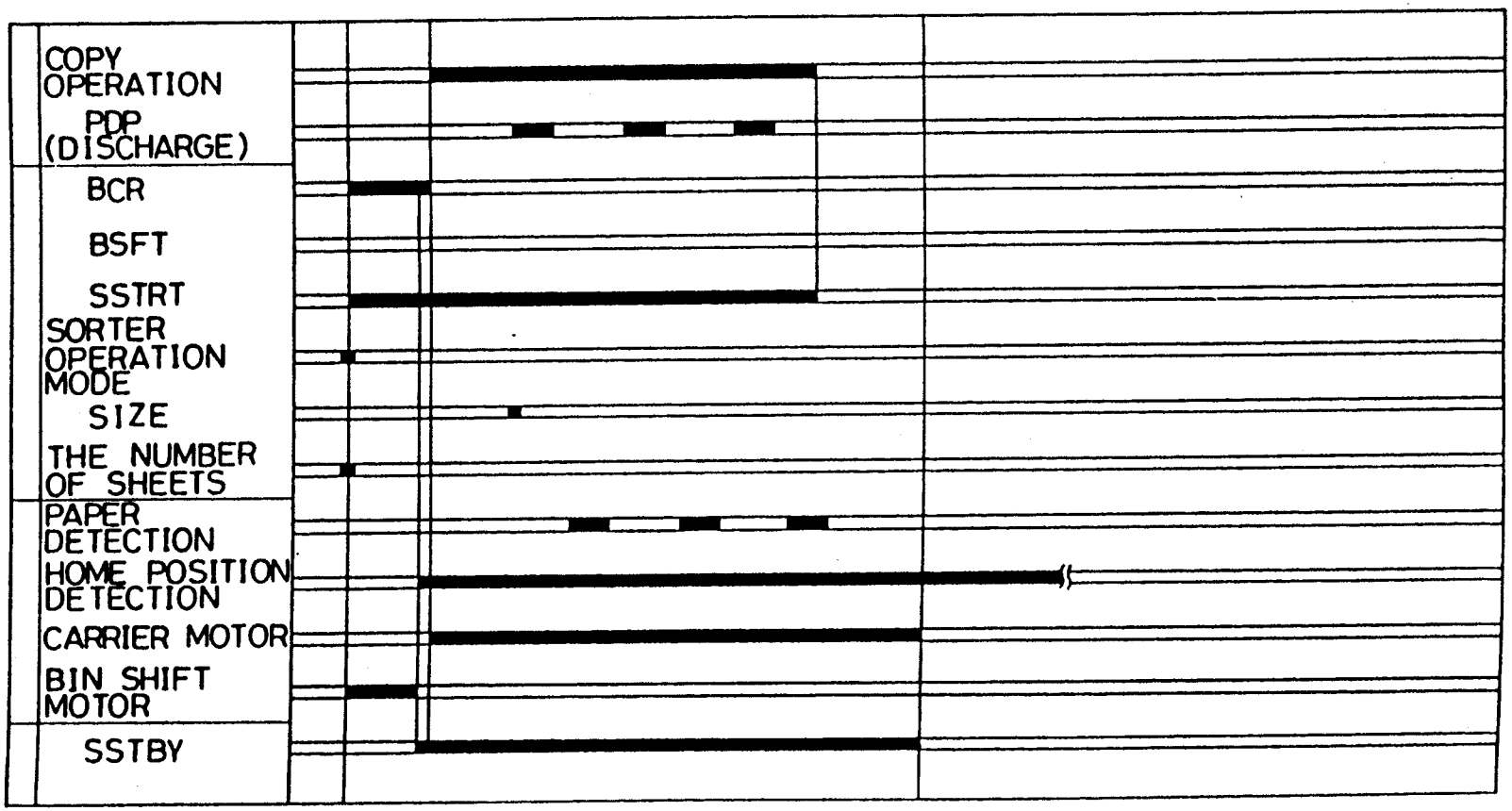
FIG. 11 is a timing chart in the non-sorting mode.

(Refer to FIG. 11)

When a copy key of the display/operation unit 11 of the copier 10 is depressed, the set copy number of sheets data (three copy sheets in this example) and an operation mode (non-sorting mode) signal in the case where the sorter operation unit is provided on the side of the copier and an operation mode determination signal in the case where a sorter operation unit 9 is provided on the side of the sorter are transmitted from the copier 10 to the sorter 13 via the serial communication. When the operation mode determination signal is received, the sorter inhibits the selection of the sorter operation mode from the operation unit 9 and operates in the operation mode (non-sorting mode in this case) which has previously been selected. (steps 17 to 21 in FIG. 9-2) Thereafter, BCR and SSTRT signals are further transmitted.

When the sorter 13 receives the BCR signal, the count value of the sorter operation mode counter (non-sorting mode) stored in the back-up RAM area is increased and the bin shift motor 15 is reversely rotated, thereby moving the bin to the home position. After the bin was completely moved, the sorter 13 stops the bin shift motor 15 and transmits an SSTBY signal to the copier 10. When the copier 10 receives the SSTBY signal from the sorter 13, it turns off the BCR signal and starts the copying operation. On the other hand, since the BCR signal was turned off, the sorter 13 makes a carrier motor 16 operative. While a sheet is passing a copier delivery sensor 12, a PBP signal is transmitted from the copier 10 to the sorter 13. When the first PDP signal is turned off, the sorter 13 determines the copy sheet size code.

The sorter 13 makes a delay jam timer operative each time the PDP signal is turned off from the on-state and checks the arrival of a sheet from the copier delivery sensor 12 to a sorter paper sensor 14. When the sheet arrives at the sensor 14, a stay jam timer is made operative, thereby checking that the sheet passes through the sensor 14 and is correctly delivered to the bin. In this case, the value of the stay jam timer is set to a time (paper size/setting speed $+\alpha$) which is slightly longer than the predicted passing time of the sheet at the sorter paper sensor 14 which was calculated on the basis of the sorter carrier speed set data (setting speed data) and copy paper size data which were transmitted in the RAM writting mode (steps 103 and 104 in FIG. 9-8).

In this case, if the actual paper passing time is fairly different from the prediction paper passing time calculated, an SPEED signal is transmitted to the copier 10. When the copier 10 receives the SPEED signal, a display indicative of an abnormality of the sorter carrier speed in the operation display unit 9 is turned on, thereby giving warning. (steps 24 to 28 in FIG. 9-2)

Further, each time the sheet passes through the sorter paper sensor 14, the sorter 13 increases the count value indicative of the number of sheets stacked in the sorter, which value is stored in the back-up RAM.

After completion of the copying operation, the copier 10 turns off the SSTRT signal. After the sorter 13 had confirmed the turn-off of the SSTRT signal, the carrier motor 16 is stopped after the third sheet passed through the sorter paper sensor 14.

The count value of each jam counter stored in the back-up RAM area is increased in the case where a jam occurred in the foregoing series of operations. Namely, it is counted up when the bin is not returned to the home position within a predetermined period of time; when the bin movement sensor is not turned on even if the bin was shifted; when the paper does not reach the sorter paper sensor 14 even after completion of the counting of the delay jam timer; when the on-state of the sensor 14 is held even after completion of the counting of the stay jam timer or the like. (steps 29 to 38 in FIG. 9-3)

2. Sorting mode (single original and three copy sheets)

Figure 12:
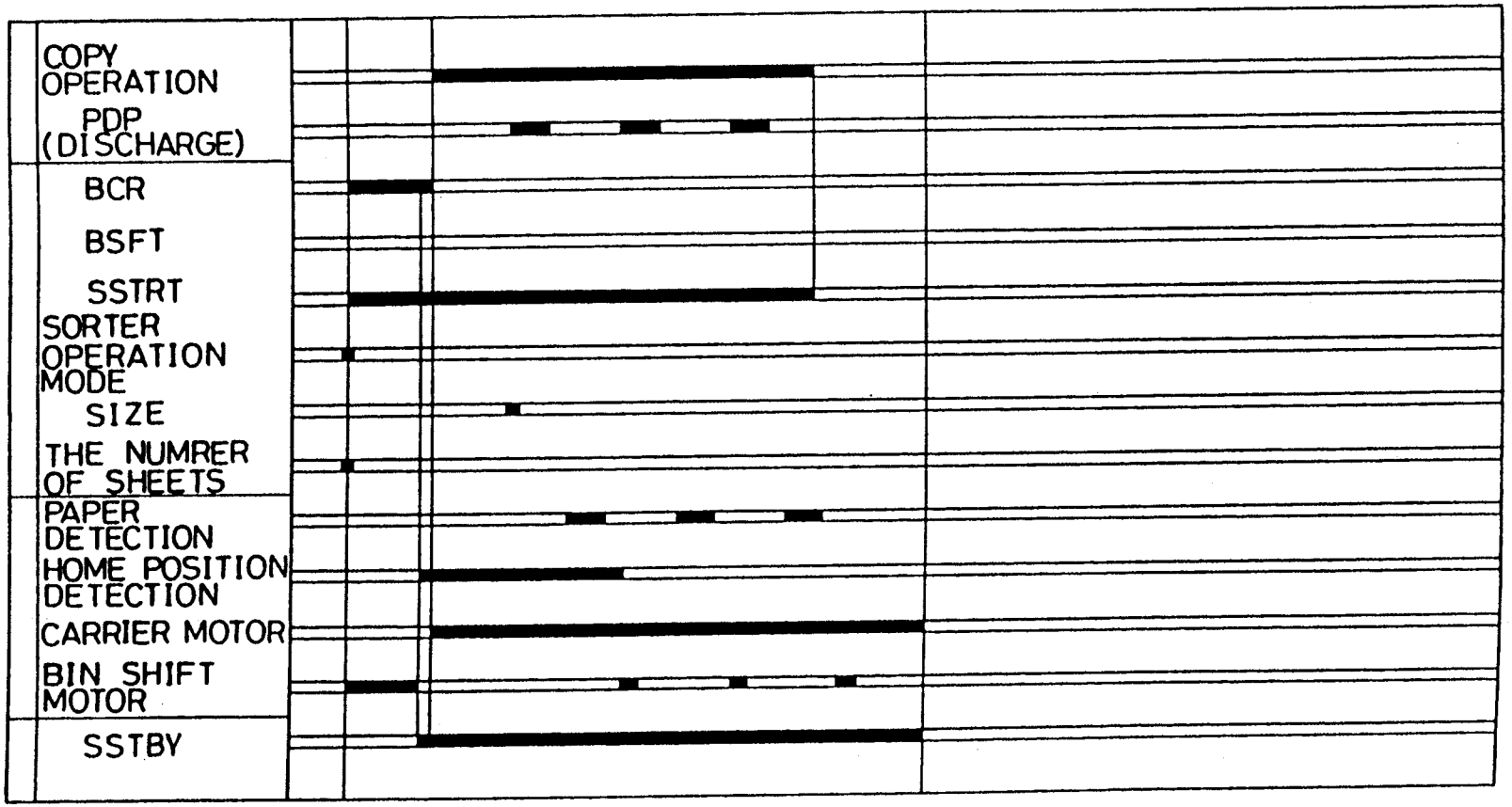
FIG. 12 is a timing chart in the sorting mode.
Figure 13:
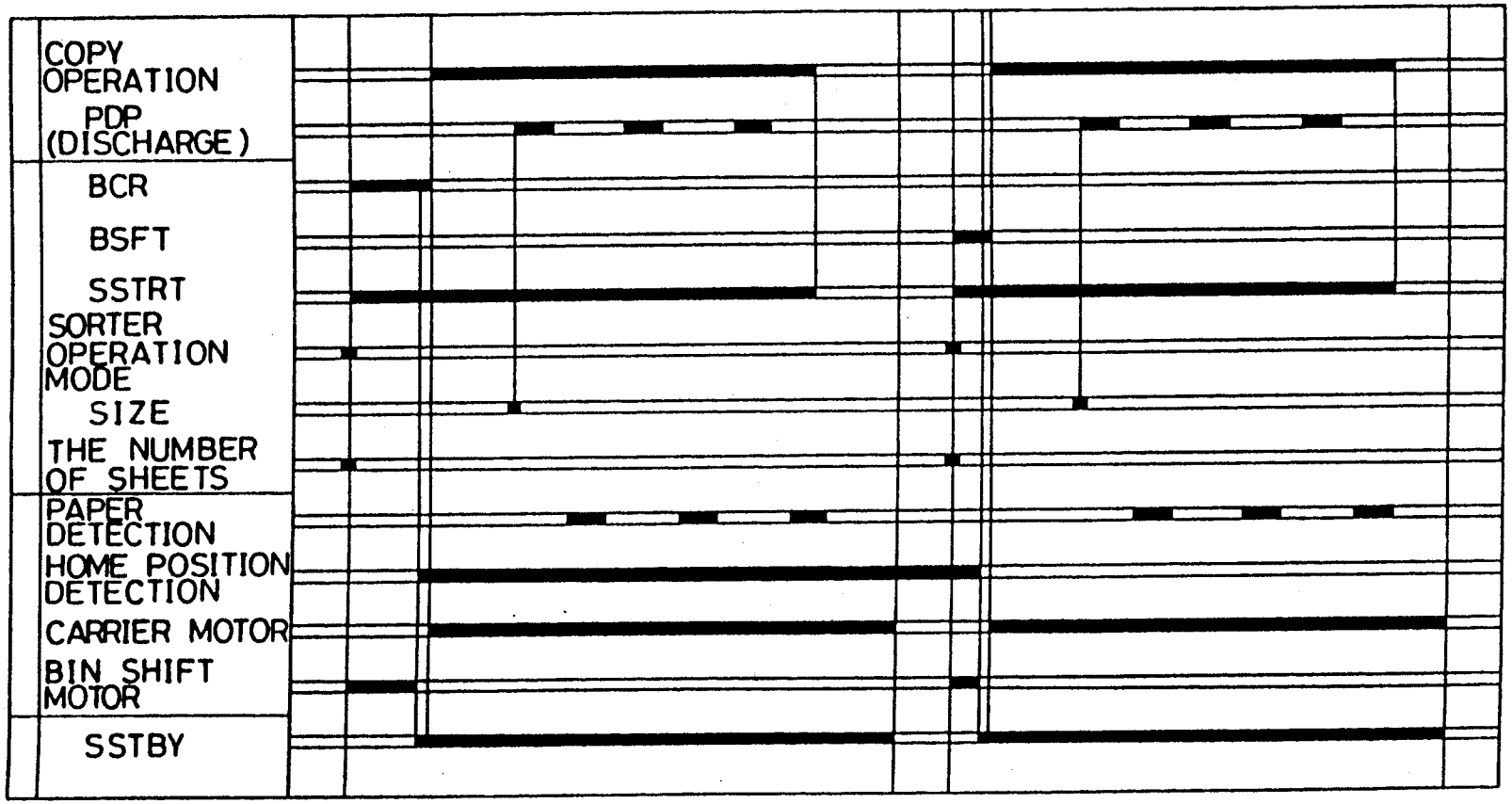
FIG. 13 is a timing chart in the collating mode.

(Refer to FIG. 12)

When the copy key in the display operation unit 11 of the copier 10 is depressed, the set copy number of sheets data (three in this example) and the operation mode (sorting mode) signal in the case where the sorter operation unit is provided on the side of the copier and the operation mode determination signal in the case where the sorter operation unit 9 is provided on the side of the sorter are transmitted from the copier 10 to the sorter 13 via the serial communication. When the sorter receives the operation mode determination signal, the sorter inhibits the selection of the sorter operation mode from the operation unit 9 and operates in the operation mode (sorting mode in this case) which has previously been selected. Thereafter, the BCR and SSTRT signals are further transmitted.

When the sorter 13 receives the BCR signal, the count value of the sorter operation mode counter (sorting mode) stored in the back-up RAM area is increased and the bin shift motor 15 is reversely rotated, thereby moving the bin to the home position. After completion of the movement of the bin, the sorter 13 stops the bin shift motor 15 and transmits the SSTBY signal to the copier 10. When the copier 10 receives the SSTBY signal from the sorter 13, the copier turns off the BCR signal and starts the copying operation. In response to the turn-off of the BCR signal, the sorter 13 makes the carrier motor 16 operative. While the sheet is passing the copier delivery sensor 12, the PDP signal is transmitted from the copier 10 to the sorter 13. When the first PDP signal is turned on, the sorter 13 determines the copy paper size code.

Each time the PDP signal is turned off from the on-state, the sorter 13 makes the delay jam timer operative and checks the arrival of the sheet from the copier delivery sensor 12 to the sorter paper sensor 14. When the sheet reaches the sensor 14, the stay jam timer is made operative, thereby checking that the sheet passes through the sensor 14 and is correctly delivered to the bin. The stay jam timer operates for the period of time which was set in steps 103 and 104 in FIG. 9-8, as mentioned above.

Further, after the elapse of a predetermined period of time after the sheet had passed the sensor 14, the bin shift motor 16 is forwardly rotated to shift the bin by only the distance corresponding to one bin. This operation is executed each time one sheet arrives.

Further, each time the sheet passes the sensor 14, the sorter 13 increases the count value indicative of the number of sheets stacked in the sorter, which value is stored in the back-up RAM area. Every time the bin is shifted by the distance of one bin, the count value indicative of the number of bin shift times stored in the back-up RAM area is increased.

After completion of the copying operation, the copier 10 turns off the SSTRT signal. After the turn-off of the SSTRT signal had been confirmed, the sorter 13 stops the carrier motor 16 after the third sheet passed the sensor 14.

3. Collating mode (two originals and three copy sheet)

(FIG. 13)

When the copy key in the display operation unit 11 of the copier 10 is depressed, the set copy number of sheets data (three in this example) and the operation mode (collating mode) signal in the case where the sorter operation unit is provided on the side of the copier and the operation mode determination signal in the case where the sorter operation unit 9 is provided on the side of the sorter are transmitted from the copier 10 to the sorter 13 via the serial communication. When the sorter receives the operation mode determination signal, it inhibits the selection mode determination signal, it inhibits the selection of the sorter operation mode from the operation unit 9 and operates in the operation mode (collating mode in this case) which has previously been selected. Thereafter, the BCR and SSTRT signals are further transmitted.

When the sorter 13 receives the BCR signal, the count value of the sorter operation mode counter (collating mode) in the back-up RAM area is increased and the bin shift motor 15 is reversely rotated, thereby moving the bin to the home position. After completion of the movement of the bin, the sorter 13 stops the bin shift motor 15 and transmits the SSTBY signal to the copier 10. When the copier 10 receives the SSTBY signal from the sorter 13, the copier turns off the BCR signal and starts the copying operation. In response to the turn-off of the BCR signal, the sorter 13 makes the carrier motor 16 operative. While the sheet is passing the copier delivery sensor 12, the PDP signal is transmitted from the copier 10 to the sorter 3. When the first PDP signal is turned on, the sorter 13 determines the copy paper size code.

Each time the PDP signal is turned off from the on-state, the sorter 13 makes the delay jam timer operative and checks the arrival of the sheet from the copier delivery sensor 12 to the sorter paper sensor 14. When the sheet reaches the sensor 14, the stay jam timer is made operative, thereby checking that the sheet passes the sensor 14 and is correctly delivered to the bin.

Further, each time the sheet passes the sensor 14, the sorter 13 increases the count value indicative of the number of sheets stacked in the sorter, which value is stored in the back-up RAM area.

After completion of the copying operation, the copier 10 turns off the SSTRT signal. After the turn-off of the SSTRT signal had been confirmed, the sorter 13 stops the carrier motor 16 after the third sheet passed the sensor 14.

At this time, if an automatic document feeder is attached to the copier 10, the set copy number of sheets data (three in this example) and the operation mode (collating mode) signal in the case where the sorter operation unit is provided on the side of the copier and the operation mode determination signal in the case where the sorter operation unit is provided on the side of the sorter are transmitted from the copier 10 to the sorter 13 via the serial communication after an original document was exchanged. If an automatic document feeder is not attached to the copier 10, these data and signal are transmitted from the copier 10 to the sorter 13 via the serial communication after the next copy start key was depressed.

When the sorter 13 receives a BSFT signal, the sorter increases the count value of the sorter operation mode counter (collating mode) stored in the back-up RAM area. After the elapse of a predetermined period of time, the bin shift motor 15 is forwardly rotated to shift the bin by only the distance corresponding to one bin. After completion of the movement of the bin, the bin shift motor 15 is stopped and the SSTBY signal is transmitted to the copier 10. Further, the sorter increases the count value indicative of the number of bin shift times stored in the back-up RAM area. When the copier 10 receives the SSTBY signal from the sorter 13, the copier turns off the BCR signal and restarts the copying operation. In response to the turn-off of the BCR signal, the sorter 13 makes the carrier motor 16 operative. After completion of the copying operation, the copier 10 again turns off the SSTRT signal. After the turn-off of the SSTRT signal had been confirmed, the sorter 13 stops the carrier motor 16 after the third sheet passed the sorter paper sensor 14. In the operation standby mode, the sorter allows the . sorter operation unit and the like to warn and display when the count value of each jam counter, the count value indicative of the number of sheets stacked in the sorter, and the count value indicative of the number of bin shift times which had been stored in the back-up RAM areas have exceeded the set values.

Although the sorter has been described as an example in the foregoing embodiment, the invention is not limited to this example. The invention can be also applied to a finisher such as sheet folding apparatus, stapler, or the like.

What we claimed is:

1. A sheet output apparatus detachably combinable with a sheet post-processing apparatus, said sheet output apparatus also adapted to perform predetermined processing of a sheet and then discharge the sheet to the sheet post-processing apparatus, comprising:

transfer means for transferring the sheet to the sheet post-processing apparatus, said transfer means transferring the sheet to a sheet container in the sheet post-processing apparatus where transferred sheets are grouped in units of a predetermined number of sheets; and communication means for communication data between said transfer means and the sheet post-processing apparatus, wherein said communication means transmits speed data representing a transfer speed of the sheet transferred to the sheet post-processing apparatus, whereby the sheet post-processing apparatus can be controlled based on the transfer speed data.

2. An apparatus according to claim, wherein said sheet output apparatus includes means for forming an image on the sheet.

3. An apparatus according to claim 1, wherein said communication means further transmits data on sheet size to the sheet post-processing apparatus.

4. An apparatus according to claim 1, wherein said communication means transmits the transfer speed data to the sheet post-processing apparatus, whereby an abnormality in the transfer speed data is detected.

5. An apparatus according to claim 4, further comprising alarm means for providing an alarm when receiving data indicating an abnormal transfer speed.

6. A sheet output apparatus useful in conjunction with a sheet post-processing apparatus, said sheet output apparatus also adapted to perform predetermined processing of a sheet and then discharge the sheet to the sheet post-processing apparatus, comprising:

transfer means for transferring the sheet to the sheet post processing apparatus, said transfer means transferring the sheet to a plurality of sheet containers in the sheet post-processing apparatus where transferred sheets are distributed and stored; and communication means for communicating data between said transfer means and the sheet post-processing apparatus, wherein said communication means transmits speed data representing transfer speed of the sheet transferred to the sheet post-processing apparatus, whereby the sheet post-processing apparatus can be controlled based on the transfer speed data.

7. A sheet output apparatus useful in conjunction with a sheet post-processing apparatus, said sheet output apparatus also adapted to perform predetermined processing of a sheet and then discharge the sheet to the sheet post-processing apparatus, comprising:

means for forming an image on the sheet;

transfer means for transferring the sheet to the sheet post processing apparatus, said transfer means transferring the sheet to a plurality of sheet containers in the sheet post-processing apparatus where transferred sheets are distributed and stored; and communication means for communicating data between said transfer means and the sheet post-processing apparatus, wherein said communication means transmits speed data representing transfer speed of the sheet transferred to the sheet post-processing apparatus, whereby the sheet post-processing apparatus can be controlled based on the transfer speed data.

* * * * *

UNITED STATES PATENT AND TRADEMARK OFFICE

CERTIFICATE OF CORRECTION

PATENT NO. : 5,205,549

DATED : April 27, 1993

INVENTOR(S) : SATO et al.

It is certified that error appears in the above-indentified patent and that said Letters Patent is hereby corrected as shown below:

COLUMN 1

Line 21, "are" should read --is-- and "is" should read --are--.
Line 27, "jam of" should read --jam or--.
Line 47, "handling" should read --output--.
Line 50, "handling" should read --output--.
Line 57, "tot he" should read --to the--.

COLUMN 2

Line 48, "microcumputer" should read --microcomputer--.
Line 54, "coum-" should read --com- --.

COLUMN 4

Line 20, "frist" should read --first--.

COLUMN 6

Line 32, "prediction" should read --predicted--.

COLUMN 8

Line 16, "sorter 3." should read --sorter 13.--.

UNITED STATES PATENT AND TRADEMARK OFFICE

CERTIFICATE OF CORRECTION

PATENT NO. : 5,205,549

DATED : April 27, 1993

INVENTOR(S) : Sato, et. al.

It is certified that error appears in the above-indentified patent and that said Letters Patent is hereby corrected as shown below:

Column 9

Line 34, "claim," should read --claim 1,--.

Signed and Sealed this

Twenty-sixth Day of April, 1994

Bruce Lehman

*Attest:*

BRUCE LEHMAN

*Attesting Officer*

*Commissioner of Patents and Trademarks*